US005769760A

United States Patent [19]

Lin et al.

[11] Patent Number: 5,769,760

[45] Date of Patent: Jun. 23, 1998

[54] STATIONARY EXERCISE DEVICE

[76] Inventors: Michael Lin; Hui-Nan Yu, both of 5F-23, 70, Fu-Shing Road, Taoyuan, Taiwan

[21] Appl. No.: 898,031

[22] Filed: Jul. 22, 1997

[51] Int. Cl.[6] ..... A63B 69/16; A63B 22/00

[52] U.S. Cl. ..... 482/52; 482/51; 482/57

[58] Field of Search ..... 482/51, 52, 53, 482/70, 57, 62, 60, 72, 71, 79, 80

[56] References Cited

U.S. PATENT DOCUMENTS

| | | | |
|---|---|---|---|
| 5,499,956 | 3/1996 | Habing et al. | 482/52 |
| 5,540,637 | 7/1996 | Rodgers, Jr. | 482/70 |
| 5,573,480 | 11/1996 | Rodgers, Jr. | 482/57 |
| 5,577,985 | 11/1996 | Miller | 482/52 |
| 5,593,372 | 1/1997 | Rodgers, Jr. | 482/51 |

*Primary Examiner*—Stephen R. Crow
*Attorney, Agent, or Firm*—Bacon & Thomas

[57] ABSTRACT

A stationary exercise device including a base frame, a load carrier unit, and two exercising units, each exercising unit including a first oscillatory arm and a second oscillatory arm respectively pivoted to the base frame, a connecting plate having a front end pivoted to the second oscillatory arm and a rear end, a guide link having a top end fixedly mounted with a hand grip and a bottom end pivoted to the rear end of the connecting plate, the top and bottom ends of the guide link being moved along a respective oval track and the middle part thereof turned on an axis when the stationary exercise device is operated.

1 Claim, 5 Drawing Sheets

STATIONARY EXERCISE DEVICE

BACKGROUND OF THE INVENTION

1. Field of the Invention

This invention relates generally to exercise equipment, more specifically, the invention relates to a stationary exercise device which is practical for the user to simulate running and stepping motions.

2. Description of the Prior Art

A variety of exercise devices for simulating running and stepping motions have been disclosed, and have appeared on the market. U.S. Pat. No. 5,549,526 discloses an exercise device having reciprocating member 32 moved back and forth on rollers 36. The exercise devices according to U.S. Pat. Nos. 5,529,554; 5,593,372; 5,540,637 and 5,573,480, roller means are moved on track means. U.S. Pat No. 5,577,985 discloses another type of exercise device in which foot links 28;30 are moved back and forth alternatively when guide links 24;26 are turned about shaft 19; foot links 28;30 are respectively turned about pivot members 32;34 along a substantially circular track by means of the operation of cranks 36;38, intermediate links 40;46 and control links 44;48. However, this structure of exercise device has numerous drawbacks. Because cranks 36;38 and foot links 28;30 are not directly coupled together, the stroke of the rotary motion of foot links 28;30 is greatly prolonged and unstable. Furthermore, because hand grips 52;54 are pivoted shaft 19, they can only be oscillated along a smoothly curved path, i.e., hand grips 52;54 cannot be moved along an oval track.

SUMMARY OF THE INVENTION

According to the preferred embodiment of the present invention, the stationary exercise device comprises a base frame, a load carrier unit, and two exercising units, each exercising unit comprising a first oscillatory arm and a second oscillatory arm respectively pivoted to the base frame, a connecting plate having a front end pivoted to the second oscillatory arm and a rear end, a guide link having a top end fixedly mounted with a hand grip and a bottom end pivoted to the rear end of the connecting plate, the top and bottom ends of the guide link being moved along a respective oval track and the middle part thereof turned on an axis when the stationary exercise device is operated.

BRIEF DESCRIPTION OF THE DRAWINGS

FIG. 4 is a schematic drawing showing the second half stroke of the movement of the movable parts of the stationary exercise device according to the present invention.

DETAILED DESCRIPTION OF THE PREFERRED EMBODIMENT

Figure 1:
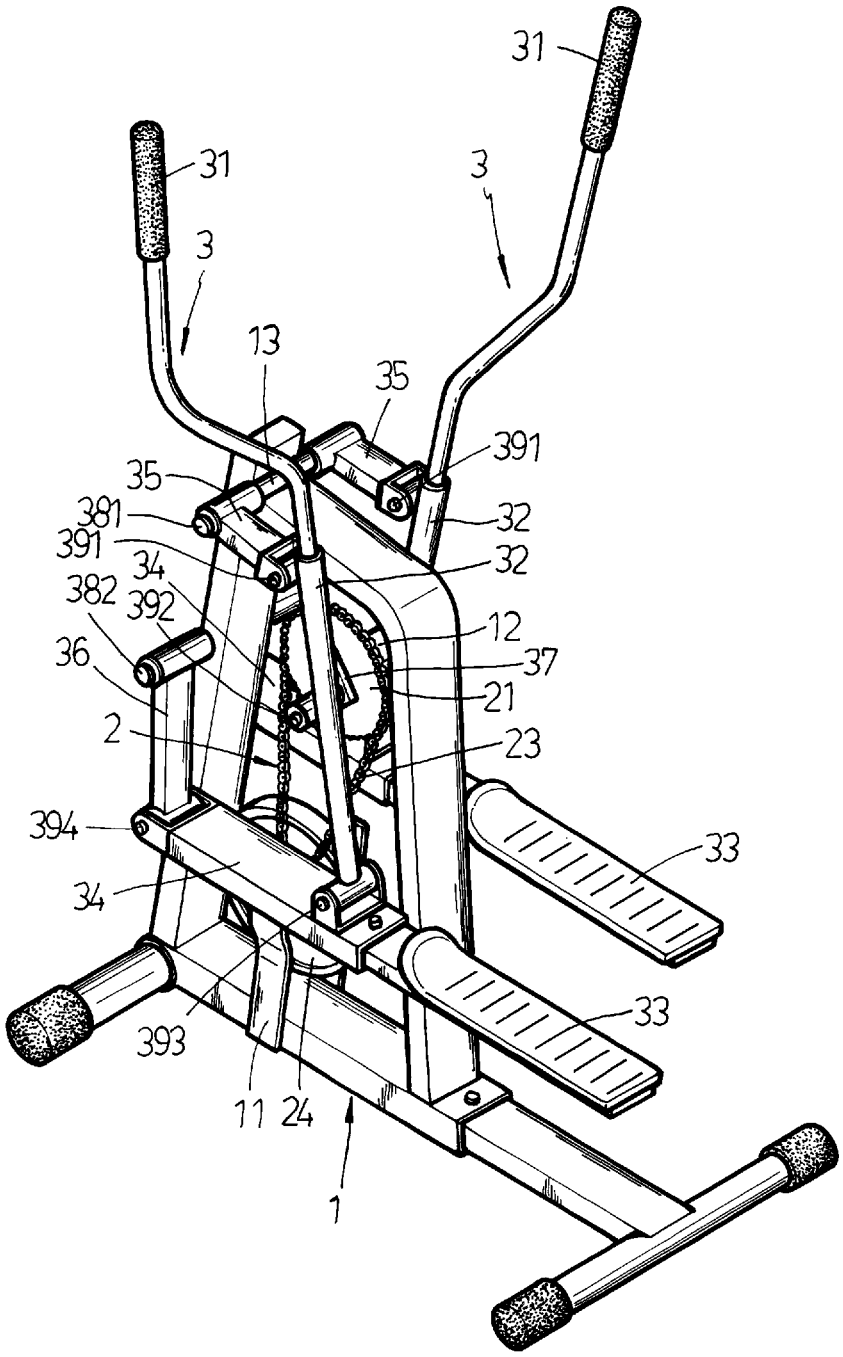
FIG. 1 is a perspective view of a stationary exercise device according to the present invention.
Figure 2:
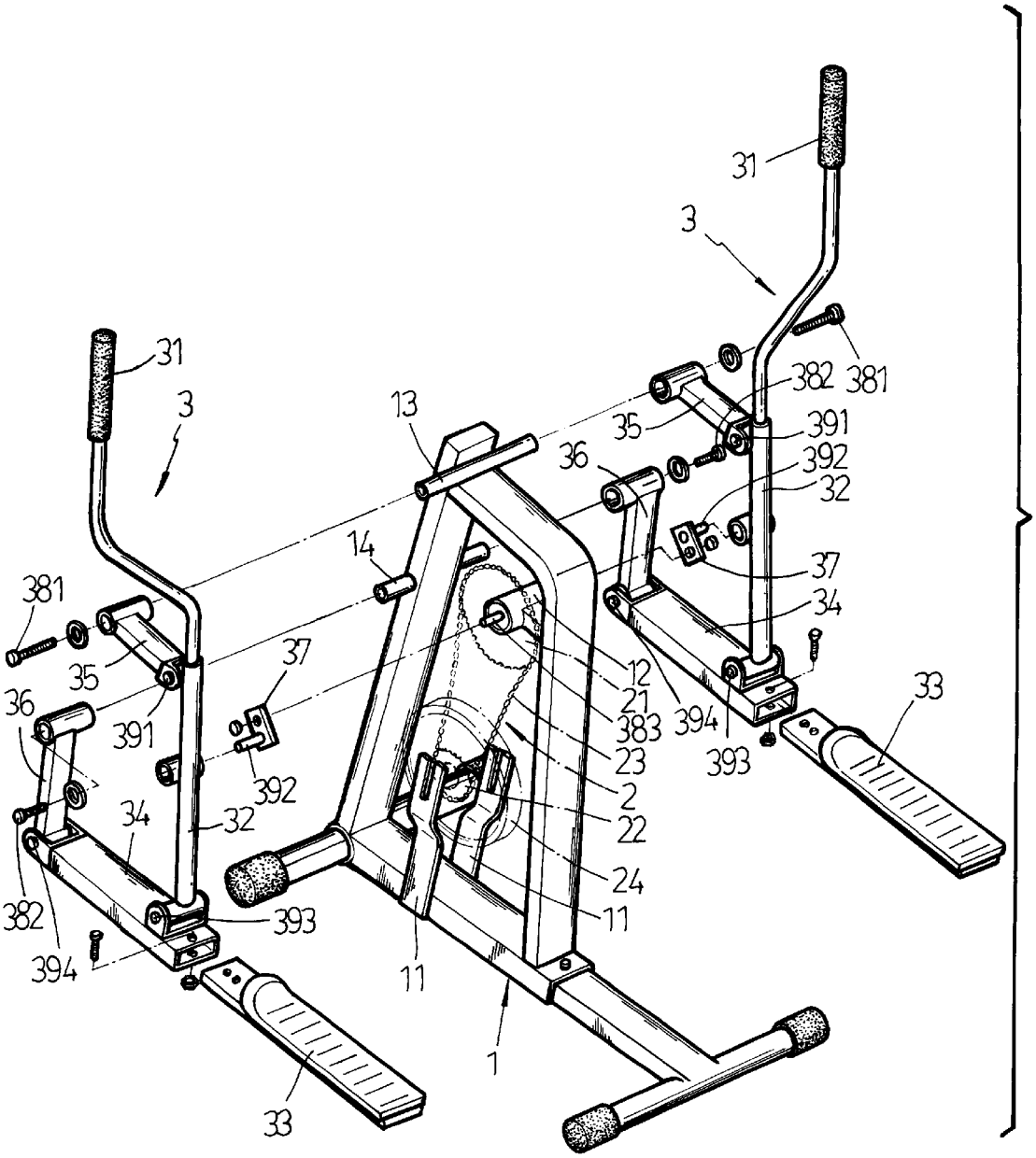
FIG. 2 is an exploded view of the stationary exercise device shown in FIG. 1.
Figure 3:
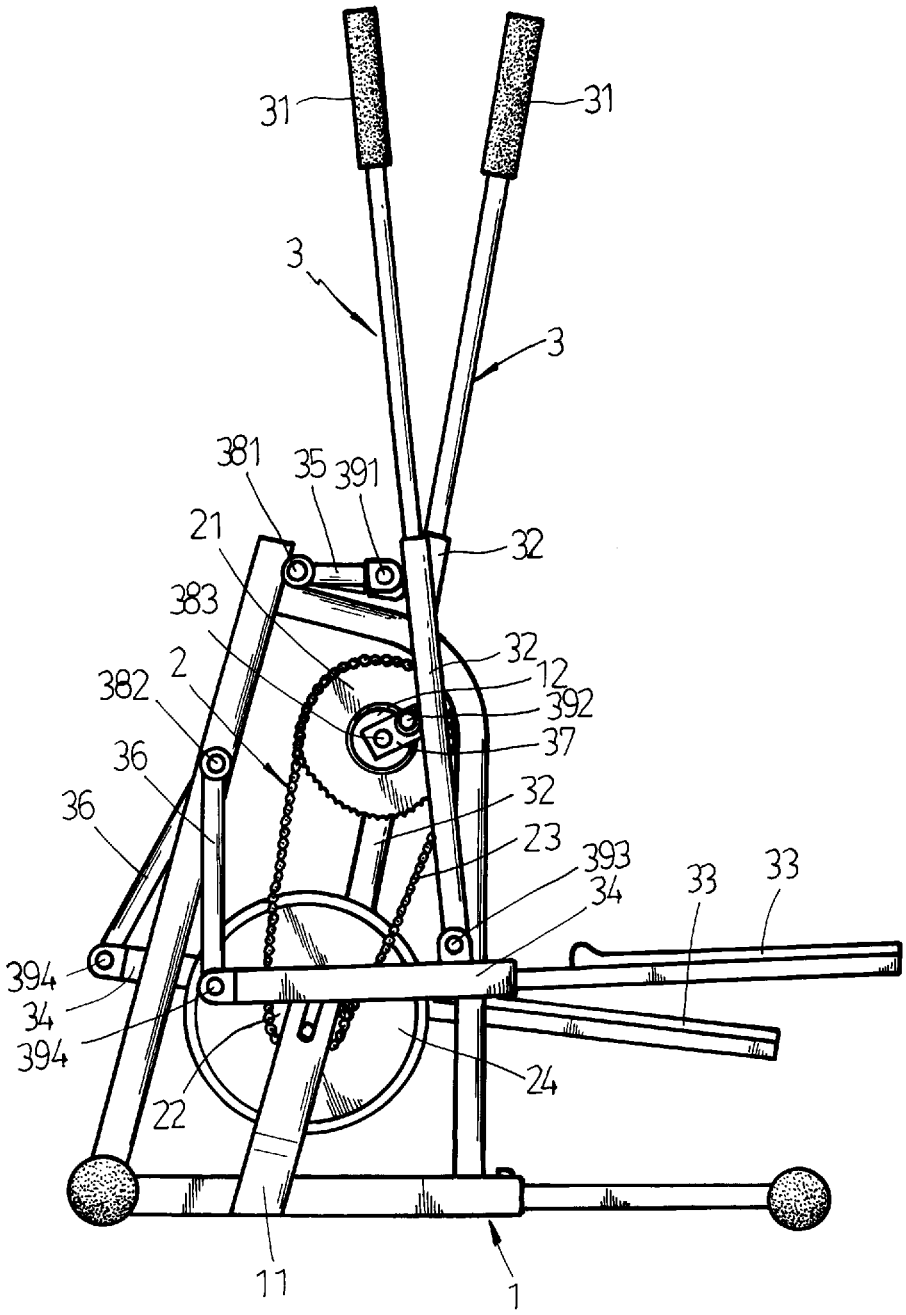
FIG. 3 is a side view of the stationary exercise device shown in FIG. 1.

Referring to FIGS. 1, 2 and 3, a stationary exercise device in accordance with the present invention is generally comprised of a base frame 1, a load carrier unit 2, and two exercising units 3. The load carrier unit 2 is supported on first support means 11 and second support means 12 of the base frame 1, comprising a drive chain wheel 21, a driven chain wheel 22, a chain 23, and a fly wheel 24. The two exercising units 3 are bilaterally supported on first transverse pivot shaft 13 and second transverse pivot shaft 14 of the base frame 1. Because the base frame 1 and the load carrier unit 2 are of the known designs, they are not described in detail.

Referring to FIGS. 1 and 2 again, the exercising unit 3 comprises a hand grip 31, a guide link 32, a pedal 33, a connecting plate 34, a first oscillatory arm 35, a second oscillatory arm 36, and a crank 37. When the parts of the exercising unit 3 are installed, a first locating pivot shaft 381 is disposed at the first transverse shaft 13 of the base frame 1, a second locating pivot shaft 382 is disposed at the second transverse shaft 14 of the base frame 1, a third locating pivot shaft 383 is disposed at the center of the drive chain wheel 21, and four movable pivot shafts, namely, the first movable pivot shaft 391, the second movable pivot shaft 392, the third movable pivot shaft 393 and the fourth movable pivot shaft 394 respectively disposed at different locations. The hand grip 31 is fixedly connected to one end, namely, the top end of the guide link 32. The top end of the guide link 32 is pivoted to one end of the first oscillatory arm 35. The opposite end of the first oscillatory arm 35 is pivoted to the base frame 1. The guide link 32 has a middle part pivoted to one end of the crank 37. The opposite end of the crank 37 is pivoted to the center of the drive chain wheel 21. The opposite end, namely, the bottom end of the guide link 32 is pivoted to the top of the connecting plate 34 near its rear end. The rear end of the connecting plate 34 is fixedly connected to one end of the pedal 33, and the front end thereof is pivoted to one end, namely, the bottom end of the second oscillatory arm 36. The opposite end, namely, the top end of the second oscillatory arm 36 is adapted to turn about the second locating pivot shaft 382. The crank 37 is adapted to turn about the third locating pivot shaft 383 and to move along a circular track.

Figure 4:
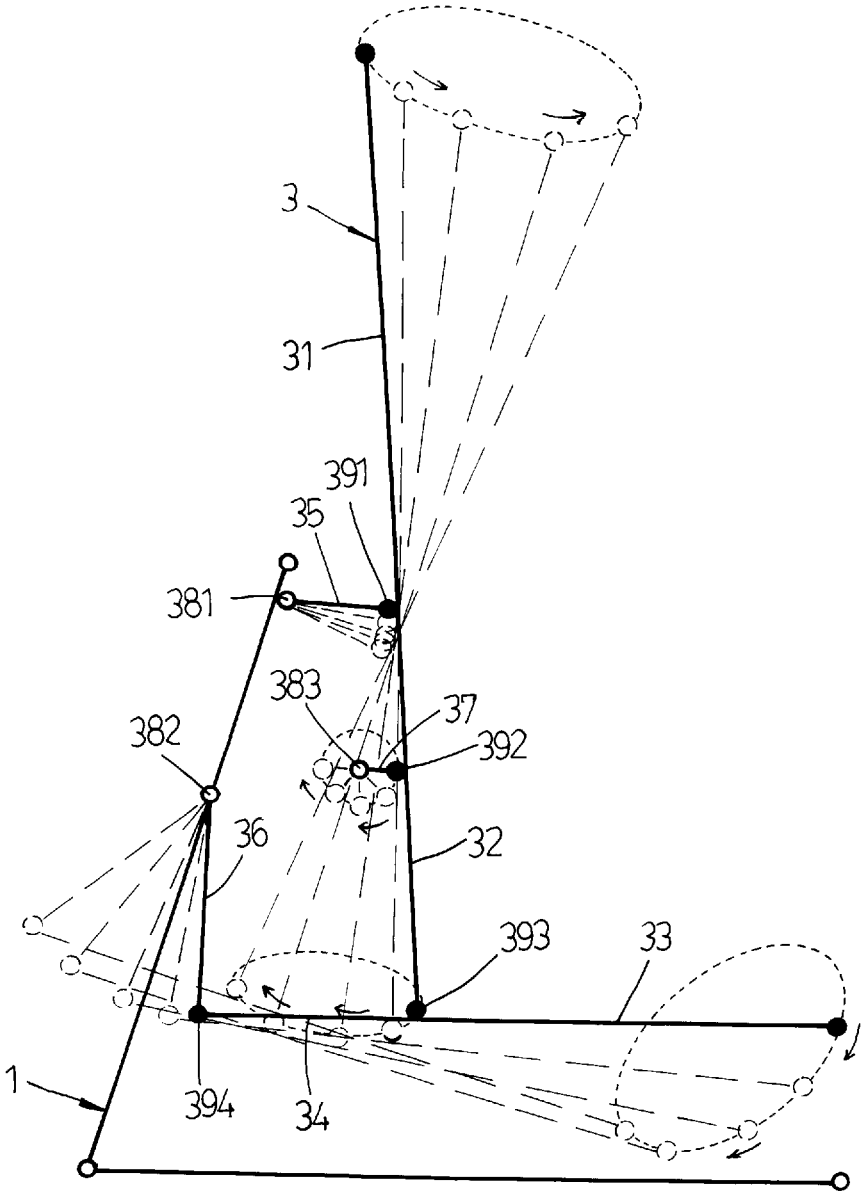
FIG. 4 is a schematic drawing showing a first half stroke of the movement of the movable parts of the stationary exercise device according to the present invention.
Figure 5:
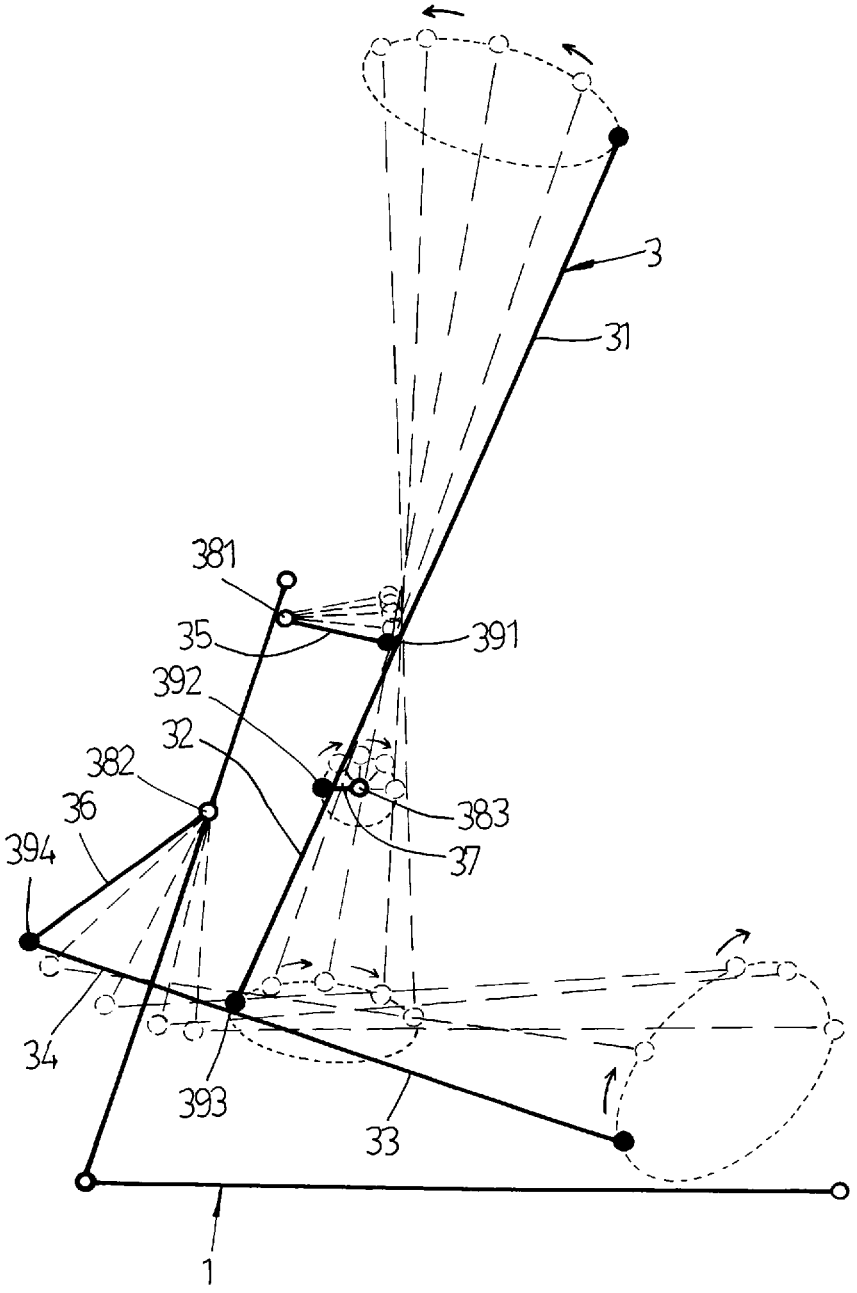

Referring to FIGS. 3, 4 and 5, the guide link 32 has a middle part pivoted to the crank 37, enabling the second movable pivot shaft 329 to move along a circular track or path around the third locating pivot shaft 383. Because the guide link 32 can also be turned about the second movable pivot shaft 329, the top and bottom ends of the guide link 32 are simultaneously moved up and down when turned with the second movable pivot shaft 329. Therefore, the top and bottom ends of the guide link 32 are simultaneously moved along a respective oval track or path when the second movable pivot shaft 392 is moved along a circular track. Assume the second movable pivot shaft 329 is the center of X (the connecting point between two reversely connected cones), the guide link 32 is moved along the periphery of the two reversely connected cones. Although the crank 37 has a limited length, the top and bottom ends of the guide link 32 are effectively forced to move along a respective oval track.

Further, because the hand grip 31 moves with the top end of the guide link 32, the first movable pivot shaft 391 must be made movable, i.e., it cannot be directly fixed to the base frame 1 so that the first oscillatory arm 35 which is pivotably connected between the first locating pivot shaft 381 and the first movable pivot shaft 391 can be turned about the first locating pivot shaft 381.

When the user steps on the pedals 33 of the exercising units 3 with the hands gripped on the hand grips 31 thereof, the pedals 33 are alternatively stepped down and the hand grips 31 are alternatively pushed and pulled.

While only one embodiment of the present invention has been shown and described, it will be understood that various modifications and changes could be made thereunto without departing from the spirit and scope of the invention disclosed.

What the invention claimed is:

1. A stationary exercise device comprising a base frame, a load carrier unit, and two symmetrical exercising units, said load carrier units comprising a main drive chain wheel, a driven chain wheel, a chain and a fly wheel, wherein each of said exercising unit comprises a hand grip, a guide link, a pedal, a connecting plate, a first oscillatory arm, a second oscillatory arm, and a crank, said first oscillatory arm and said second oscillatory arm being respectively pivoted to said base frame, said crank having one end pivoted to the center of the drive chain wheel of said load carrier unit and an opposite end pivoted to a middle part of said guide link, said guide link having a top end fixedly connected to said hand grip and pivoted to said first oscillatory arm and a bottom end pivoted to a top side of said connecting plate, said connecting plate having a front end pivoted to said second oscillatory arm and a rear end fixedly connected to said pedal, the top and bottom ends of said guide link being moved along a respective oval path and the middle part thereof turned on an axis when the stationary exercise device is operated.

* * * * *